US007931079B2

(12) United States Patent
Nicholson

(10) Patent No.: US 7,931,079 B2
(45) Date of Patent: Apr. 26, 2011

(54) TUBING HANGER AND METHOD OF COMPENSATING PRESSURE DIFFERENTIAL BETWEEN A TUBING HANGER AND AN EXTERNAL WELL VOLUME

(75) Inventor: Joseph Allan Nicholson, Cumbria (GB)

(73) Assignee: Schlumberger Technology Corporation, Sugar Land, TX (US)

( * ) Notice: Subject to any disclaimer, the term of this patent is extended or adjusted under 35 U.S.C. 154(b) by 93 days.

(21) Appl. No.: 12/142,930

(22) Filed: Jun. 20, 2008

(65) Prior Publication Data

US 2009/0044956 A1 Feb. 19, 2009

Related U.S. Application Data

(60) Provisional application No. 60/956,624, filed on Aug. 17, 2007.

(51) Int. Cl.
*E21B 19/00* (2006.01)

(52) U.S. Cl. ..... 166/89.2; 166/75.14; 166/95.1; 166/382

(58) Field of Classification Search ..... 166/382, 166/89.2, 95.1, 75.14
See application file for complete search history.

(56) References Cited

U.S. PATENT DOCUMENTS

| | | | | |
|---|---|---|---|---|
| 3,275,032 | A * | 9/1966 | Gruller | 137/868 |
| 3,491,831 | A * | 1/1970 | Dollison | 166/72 |
| 3,963,297 | A | 6/1976 | Panek et al. | |
| 4,090,565 | A * | 5/1978 | McGee | 166/379 |
| 4,174,875 | A | 11/1979 | Wilson et al. | |
| 4,819,967 | A * | 4/1989 | Calder et al. | 285/18 |
| 4,907,980 | A | 3/1990 | Wagaman et al. | |
| 5,051,103 | A * | 9/1991 | Neuroth | 439/192 |
| 5,052,941 | A | 10/1991 | Hernandez-Marti | |
| 5,143,158 | A * | 9/1992 | Watkins et al. | 166/344 |
| 6,119,773 | A | 9/2000 | Gariepy | |
| 6,145,594 | A * | 11/2000 | Jones | 166/368 |
| 6,511,335 | B1 | 1/2003 | Rayssiguier | |
| 6,582,145 | B1 | 6/2003 | Malone | |
| 6,598,680 | B2 * | 7/2003 | DeBerry | 166/368 |
| 6,626,239 | B2 * | 9/2003 | Cunningham et al. | 166/95.1 |
| 6,758,277 | B2 | 7/2004 | Vinegar | |
| 6,966,383 | B2 * | 11/2005 | Milberger et al. | 166/368 |
| 7,182,134 | B2 | 2/2007 | Wetzel | |
| 7,222,676 | B2 | 5/2007 | Patel | |
| 7,407,011 | B2 * | 8/2008 | Kent | 166/368 |
| 2002/0023751 | A1 * | 2/2002 | Neuroth et al. | 166/302 |
| 2003/0047317 | A1 * | 3/2003 | Powers | 166/373 |
| 2003/0136556 | A1 | 7/2003 | Cornelssen et al. | |
| 2005/0230122 | A1 | 10/2005 | Cho | |
| 2007/0056723 | A1 * | 3/2007 | Hall et al. | 166/65.1 |
| 2008/0017383 | A1 * | 1/2008 | Minassian et al. | 166/338 |
| 2008/0227322 | A1 * | 9/2008 | Nicholson | 439/271 |

FOREIGN PATENT DOCUMENTS

| | | |
|---|---|---|
| GB | 2058881 A | 4/1981 |
| GB | 2366673 | 3/2002 |
| WO | 9931540 A1 | 6/1999 |
| WO | 0026998 A1 | 5/2000 |

* cited by examiner

*Primary Examiner* — Jennifer H Gay
(74) *Attorney, Agent, or Firm* — Brandon S. Clark; Rodney Warfford

(57) ABSTRACT

A tubing hanger and method for reducing loads and stresses on sealing boundaries in a tubing hanger is provided. The tubing hanger has an inner cavity that is sealed with respect to an external well volume present in for example the surrounding tree architecture and wellhead. A control line extends through the inner cavity to communicate with downhole equipment. A pressure compensator is configured to adjust pressure differential between the inner cavity and the external well volume.

14 Claims, 5 Drawing Sheets

TUBING HANGER AND METHOD OF COMPENSATING PRESSURE DIFFERENTIAL BETWEEN A TUBING HANGER AND AN EXTERNAL WELL VOLUME

CROSS-REFERENCE TO RELATED APPLICATION

This application claims the benefit of U.S. Provisional Patent Application No. 60/956,624, filed Aug. 17, 2007, which is incorporated herein by reference.

FIELD

The present application relates generally to the petroleum extraction industry, and particularly to tubing hangers installed in oil well completions.

BACKGROUND

In oil well completions, a tubing hanger typically is located in the wellhead and is attached to the topmost joint in the production tubing string. Control lines including power cables, electrical cables, fiber optic cables, and the like are often run through a sealed inner cavity in the tubing hanger to communicate with downhole equipment, such as electric submersible pumps. Sealing and insulation devices are incorporated into the tubing hanger to insulate the control lines and to isolate the inner cavity from external well volumes present in for example the surrounding tree architecture and wellhead environment. These sealing and insulation devices typically include thermal plastic materials such as polyetheretherketone (PEEK), polytetrafluoroethylene (PTFE), and the like.

SUMMARY

Conventional oil well completions can operate under conditions of high pressure and high temperature. These two conditions, when combined, can cause damage across the sealing boundaries in the tubing hanger (e.g. creep). This problem is particularly difficult in large-sized power connections and penetrations, which receive large electrical loads and compressive stresses. The present application recognizes this problem and provides a unique tubing hanger and method for reducing the loads and stresses on sealing devices in a tubing hanger while maintaining environmentally secure containment and separation in the well.

In one example, a tubing hanger has an inner cavity that is sealed with respect to an external well volume present in for example the surrounding tree architecture and/or wellhead. A control line extends through the inner cavity to communicate with downhole equipment. A pressure compensator is configured to reduce pressure differential (e.g. fluid pressure differential) between the inner cavity and the external well volume. The pressure compensator can include an expandable and contractible container, such as for example a bellows, which changes size in response to the pressure differential between the inner cavity and the external well volume.

In the illustrated example, a container in the inner cavity expands when there is a negative difference between the pressure in the inner cavity and the pressure in the external well volume. Expansion of the container results in an increase in the pressure in the inner cavity by decreasing the volume in the inner cavity. In a further example, the container contracts when there is a positive difference between the pressure in the inner cavity and the pressure in the external well volume. Contraction of the container decreases the pressure in the inner cavity by increasing the volume of the inner cavity.

In one example of the method, a tubing hanger body is provided that has an inner cavity that is sealed with respect to an external well volume. A control line is passed through the inner cavity and the tubing hanger body is installed onto the well completion. During or after the tubing hanger is installed onto a well completion, a pressure compensator is operated to minimize pressure differential between the inner cavity and the external well volume.

BRIEF DESCRIPTION OF THE DRAWINGS

The best mode of carrying out the invention is presently described with reference to drawing FIGS. 1-5.

DETAILED DESCRIPTION OF THE DRAWINGS

This section of the application describes tubing hangers and methods that exemplify various aspects of the presently claimed invention. It should be understood that the examples described and depicted herein are susceptible to embodiments in many different forms and the application and drawings are not intended to limit the broad aspects claimed in the appended claims. For example, although the examples described herein refer to tubing hangers in a horizontal well completion, it is recognized that the tubing hangers and methods described and set forth in the appended claims are adaptable for use in and with a variety of other well completion systems and structures. Further, the concepts set forth herein are not limited for use with the particular tubing hanger shown and described. And although an electrical penetration is shown and described, the invention is suitable for use with other types of penetrations including fiber optic, hydraulic and the like.

Figure 1:
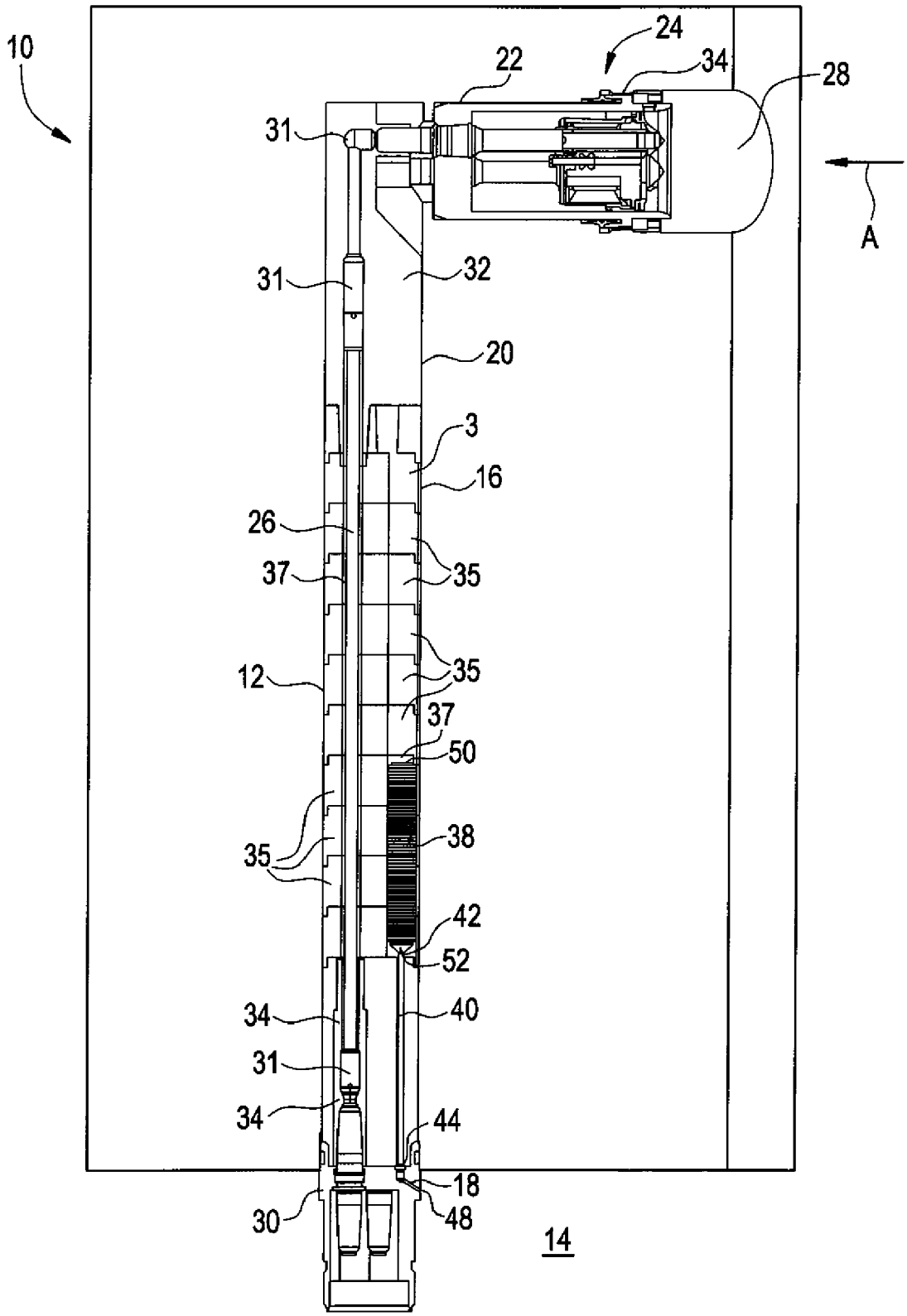
FIG. 1 is a cross-sectional view of a tubing hanger body.

FIG. 1 depicts a tubing hanger body 10, which is part of a tree tubing hanger or the like. The tubing hanger body 10 defines an inner cavity 12 that is sealed from fluid such as brine or seawater existing in an external well volume 14 for example in the surrounding tree architecture or wellhead structure (not shown). The inner cavity 12 includes a main passageway 16 and three secondary passageways 18 (only one of which is shown in the drawings). The main passageway 16 includes a first section 20 and a second section 22. The secondary passageways 18 extend tangentially from the first section 20 of the main passageway 16 and connect to the external well volume 14.

An electrical penetration 24 extends through the main passageway 16 and communicates with another control line (not shown) that is connected to downhole equipment such as a submersible pump (not shown). The particular electrical penetration 24 shown is a three-phase high voltage power connector application that has three electrical cables or control lines 26 (only two of which are shown in the drawings) extending between an uphole wet mate connector 28 and a downhole dry mate connector 30. The control lines 26 and wet mate connector 28 are disposed in the first section 20 of the main passageway 16 and the dry mate connector 30 is disposed in the second section 22 of the main passageway 16.

The control lines 26 are connected to the respective wet mate connector 28 and dry mate connector 30 at cable junctions or connection points 31.

An insulating element 32 is disposed in the main passageway 16 and provides insulation around the cable junctions or connection points 31. In the example shown, the insulating element 32 is made of an elastomeric material such as silicone rubber, however the insulating element 32 can be made of any other conventional insulating material. Sealing devices 34 are also provided between the electrical penetration 24 and the inner cavity 12 to prevent fluid communication between the inner cavity 12 and the external well volume 14. For example, O-rings and/or sealant material formed of polyetheretherketone (PEEK), polytetrafluoroethylene (PTFE) and/or the like create fluid-tight seals between the inner cavity 12 and the wet mate connector 28 and dry mate connector 30, respectively.

Figure 4:
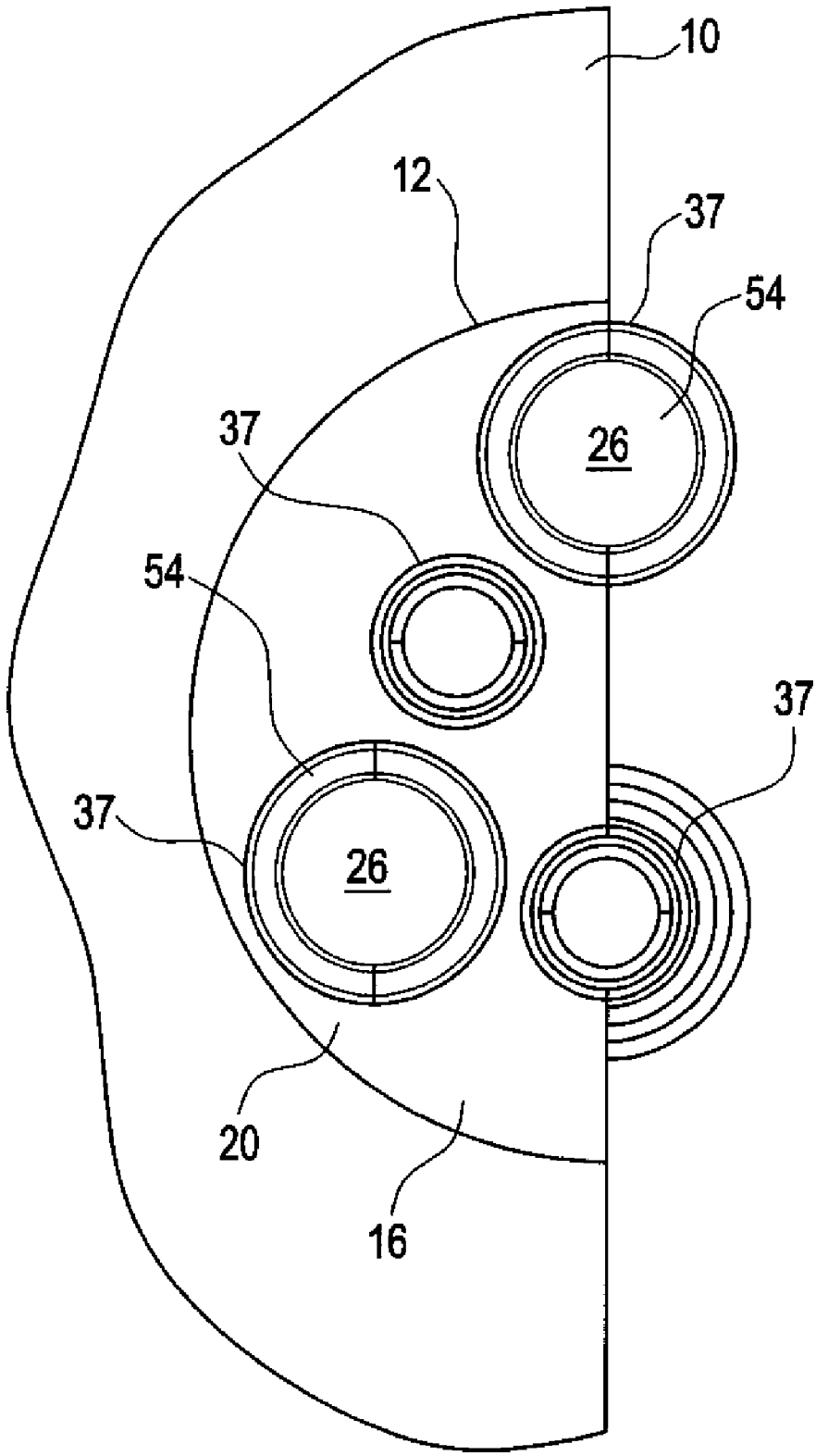
FIG. 4 is a view of Section 4-4 taken in FIG. 2.

Referring to FIGS. 1 and 4, a group of spacer blocks 35 are disposed in the main passageway 16. Spacer blocks 35 are preferably made of PEEK, however any conventional spacer material will suffice. Each spacer block 35 has several spaced holes 36 positioned such that when the spacer blocks 35 are stacked, respective holes 36 in adjacent blocks 35 align with each and define spaced conduits 37 for the three control lines 26 and for the compensation apparatus that will be described herein below. The preferred example includes a plurality of spacer blocks 35 to facilitate easier installation and repair. During installation, the plurality of spacer blocks 35 are stacked together to form part of a cartridge assembly that can easily be installed from the base of the tubing hanger. The cartridge assembly and installation process will be described further herein below. Note however that it is possible to use a single elongated spacer block instead of the depicted group of spacer blocks 35. Also, the number of spacer blocks 35 in the group can vary depending on the length of the main passageway 16 between the dry mate connector 30 and the insulating element 32 and the particular dimensions of each spacer block 35 in the group.

Figure 3:
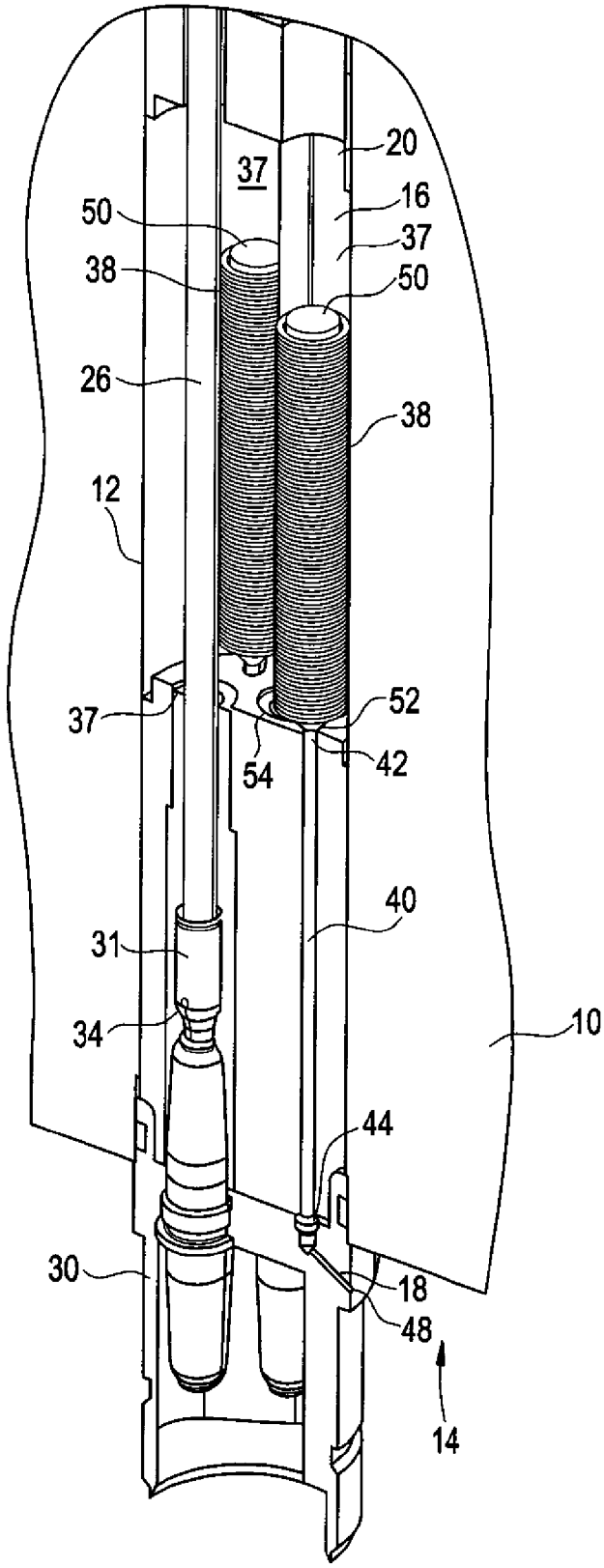
FIG. 3 is a perspective view of the partial view in FIG. 2.
Figure 5:
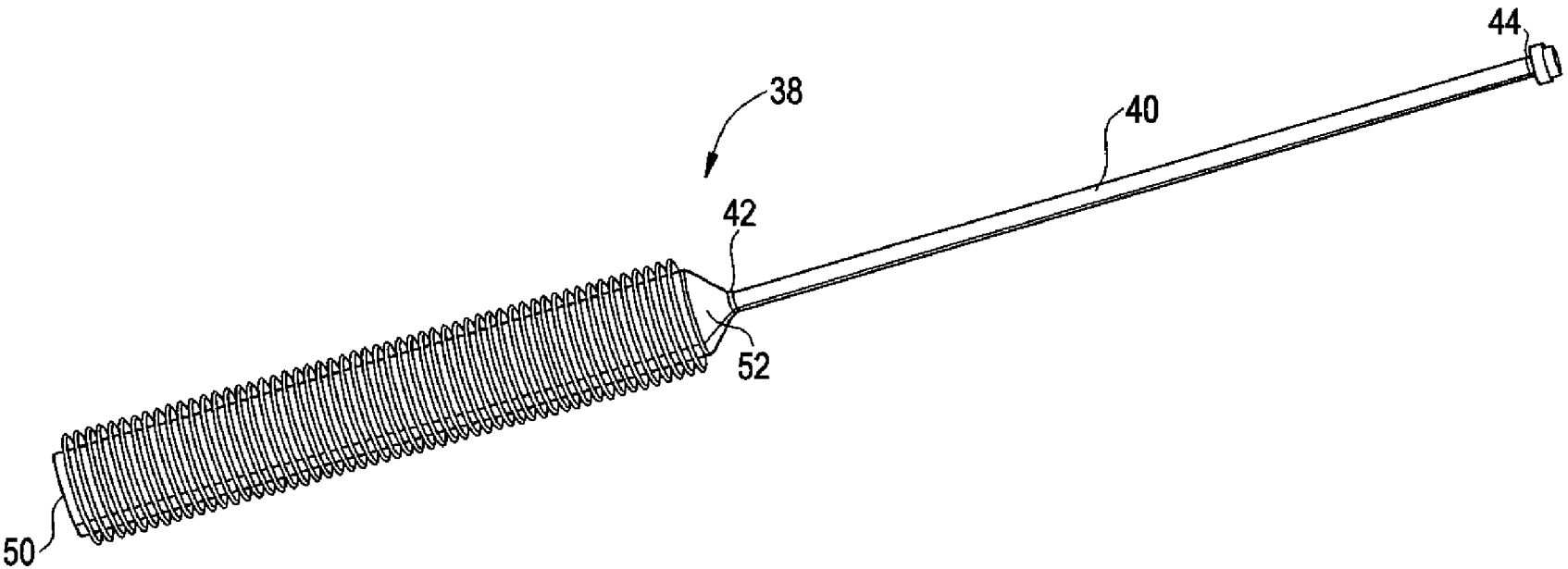
FIG. 5 is a perspective view of a compensation bellows.

Referring to FIGS. 3 and 5, three axially elongated containers or compensation bellows 38 (only two of which are shown in the drawings) are provided in the inner cavity 12. Each bellows 38 is preferably made of thin metal tubing or other suitable material so that the bellows 38 possesses a low spring rate characteristic and is easily deflected under differential pressure conditions. In the preferred example, the bellows 38 are made of Inconel® or Monel® however any other suitable metal or the like having resistance to corrosion and cracking will suffice. A tube 40 is connected to the bellows 38. The tube 40 has a first end 42 that communicates with the inside of the bellows 38 and a second end 44 that is open to the external well volume 14 so that fluid is allowed to travel through the tube 40 and into the interior of the bellows 38. The tube 40 is welded to the bellows 38 however any other suitable means of connection can be used. In the preferred example, the bellows 38 is in the shape of a convoluted tube, as shown in FIG. 5, and the convolutions 46 facilitate expansion and/or contraction of the bellows 38 in the axial direction. However the bellows 38 can have any other shape and design that will at least facilitate expansion and/or contraction. And although the particular application shown and described has three bellows 38, it is possible to use any number of bellows 38 to compensate pressure differentials, as will be described further below.

Figure 2:
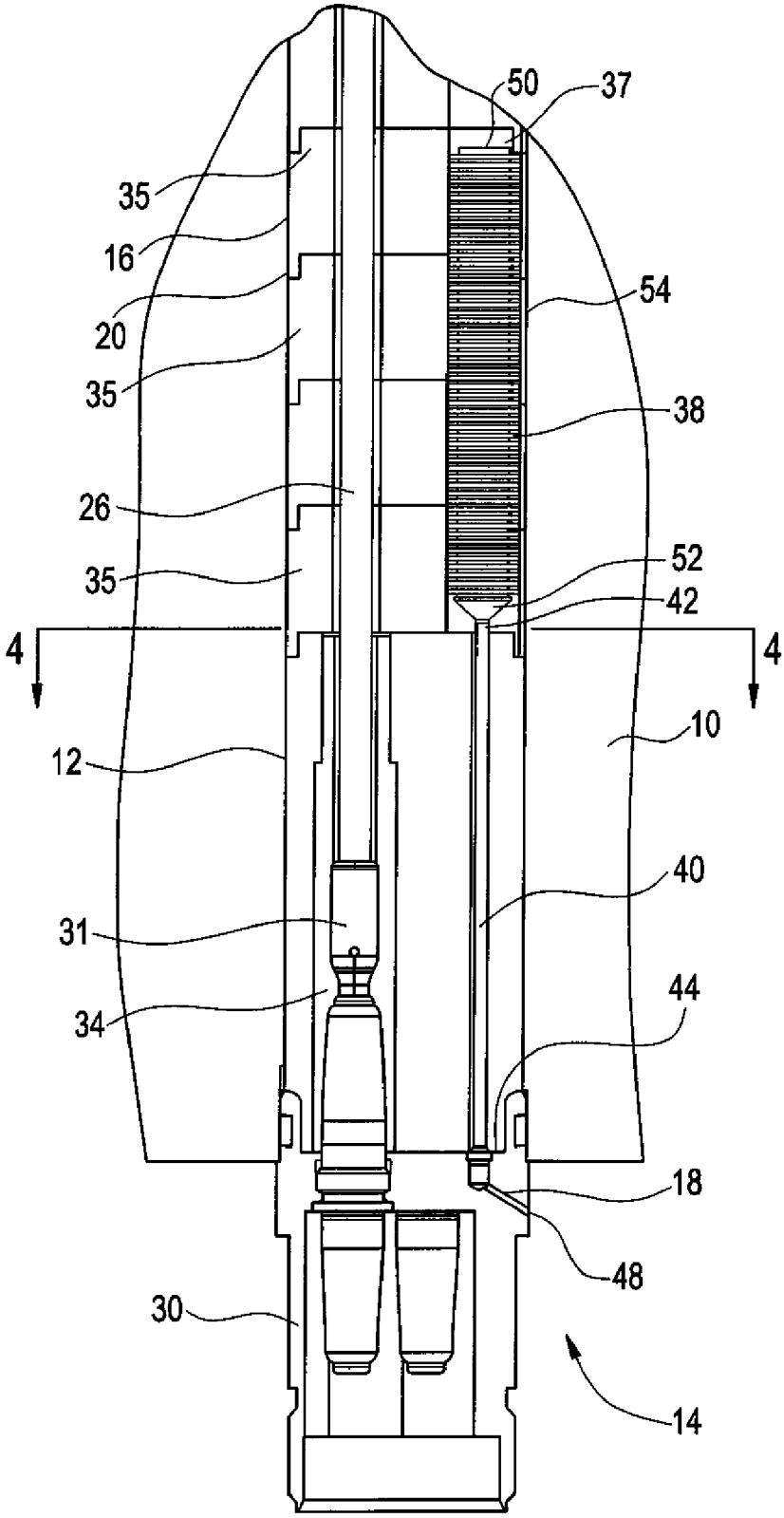
FIG. 2 is a partial view of the tubing hanger body shown in FIG. 1.

Referring to FIGS. 2 and 3, the three bellows 38 are disposed in the inner cavity 12 and are spaced apart in the main passageway 16 amongst the control lines 26. Each tube 40 extends from a respective bellows 38 through a respective secondary passageway 18 to a port hole 48 that is open to the surrounding external well volume 14. The lowermost portion of the tube 40 is sealed to the inner portion of the secondary passageway 18 to prevent fluid from entering or exiting the inner cavity. In this manner, the interior of the bellows 38 is placed in fluid communication with the external well volume 14 via the tube 40. Each compensation bellows 38 is disposed in a conduit 37 defined by the group of spacer blocks 35. The conduit 37 guides the expansion and contraction of the bellows 38. In the preferred embodiment, a stainless steel or other type of metal spacer sleeve (not shown) is disposed between the bellows 38 and the spacer block 35 and prevents wear between the outer surface of the bellows 38 and the inner surface of the spacer blocks 35. The bellows 38 includes a flat top surface 50 and a convex or sloped bottom surface 52. The bottom surface 52 is shaped and sized to mate with a concave or correspondingly sloped engagement seat surface 54 formed in the bottommost spacer block 35 in the group or the uppermost face of the dry mate connector 20. Mating of the bottom surface 52 and seat surface 54 facilitates proper landing and alignment of the axially movable bellows 38, as will be described further below.

Referring to FIG. 1, the control lines 26, insulating element 32, spacer blocks 35 and bellows 38 are preferably consolidated into a cartridge assembly that can easily be installed from the base of the tubing hanger prior to connection of the hanger to the tubing string. The spacer blocks 35 advantageously allow the lower end of the cartridge assembly to be installed into the tubing hanger at the correct orientation and ready to receive electrical contacts on the wet mate connector 28. Once the cartridge assembly is installed in the tubing hanger body 10, the wet mate connector 28 is stabbed into the cartridge assembly from a tangential direction (shown at arrow A) to form the depicted tangential or right-angled connection to the cartridge assembly. The particular arrangement shown and described facilitates the right-angled connection to allow connection and of the electrical penetration 24 within known tubing hanger space constraints. However the right-angled connection is not necessary.

Once the penetration 24 is completed, dielectric fluid is inserted into the inner cavity 12 and any air surrounding the fluid is removed by application of a vacuum to thereby free the electrical penetration 24 from electrical discharges normally associated with high voltage applications. The spacer blocks 35 reduce the volume of oil necessary to fill the inner cavity 12, which advantageously reduces the amount of working stress (e.g. deflection) on the bellows 38, as will be apparent from the following operational description.

In use, each bellows 38 works to equalize the dielectric fluid pressures in the inner cavity 12 and the external well volume 14. Specifically, each bellows 38 is configured to axially expand and/or contract along its respective conduit 37 in the spacer blocks 35. When there is a negative difference between the pressure of the fluid in the inner cavity 12 and the pressure of the fluid in the external well volume 14, the pressure of the fluid in the external well volume 14 expands the bellows 38. Expansion of the bellows 38 increases the pressure in the inner cavity 12 by decreasing the volume of the inner cavity 12. When there is a positive difference between the pressure of the fluid in the inner cavity 12 and the pressure of the fluid in the external well volume 14, the fluid in the inner cavity acts on the top surface 50 of the bellows 38 to compress the bellows 38. Decreasing the size of the bellows 38 increases the volume of the inner cavity 12, which in turn decreases the pressure of the fluid in the inner cavity 12. The spacer blocks 35 decrease the amount of dielectric oil necessary to fill the inner cavity 12 and thus advantageously reduce the amount of work performed by the bellows 38 during large changes in temperature and the resulting oil expansion.

In one preferred example, the dielectric oil in the inner cavity 12 will initially have a relatively low pressure, such as one atmosphere. As the tubing hanger is installed in for example a subsea environment, fluid in the surrounding wellhead annulus will increase as the subsea depth increases. The fluid from the surrounding annulus thus enters the inside of the bellows 38 via the port 42 and tube 40 and acts on the bellows 38 to expand it. As the bellows 38 expands into the main passageway 16, the volume of the inner cavity 12 is decreased. Thus the increasing pressure from the surrounding annulus is transferred to the inner cavity 12 and the relative pressures in the inner cavity 12 and external well volume 14 are equalized. By working to equalize the pressures in the inner cavity 14 and the external well environment 14, the pressure compensator or bellows 38 decreases the amount of pressure and stress on the sealing boundaries in the tubing hanger. This reduces failure in the sealing devices 34, spacer blocks 35 and insulation element 32. In the preferred embodiment, the pressure compensator or bellows 38 is formed of metal, which will provide a stronger barrier to fluid pressure than conventional elastomeric materials.

It is recognized that while the present application teaches a pressure compensator that expands into an inner cavity to increase pressure inside the inner cavity 12 of a tubing hanger body 10 and contracts to decrease pressure inside the inner cavity 12 of the tubing hanger body 10, it is also possible to achieve the objects described in this application by providing a pressure compensator that contracts towards the inner cavity 12 to increase pressure inside the inner cavity 12 and expands away from the inner cavity 12 to decrease pressure inside the inner cavity 12. Such an arrangement falls within the scope of the appended claims.

What is claimed is:

1. A tubing hanger comprising:

a tubing hanger body having an inner cavity that is sealed with respect to an external well volume;

a spacer block disposed within the inner cavity, wherein the spacer block comprises first and second conduits at least partially disposed therein, wherein the spacer block is configured to space the control line from the pressure compensator, a control line extending through the inner cavity and through the first conduit to communicate with downhole equipment; and a pressure compensator disposed within the second conduit and being configured to adjust pressure differential between the inner cavity and the external well volume.

2. The tubing hanger of claim 1, wherein the pressure compensator comprises a container that changes size in response to the pressure differential.

3. The tubing hanger of claim 2, wherein the container expands when there is a negative difference between the pressure in the inner cavity and the pressure in the external well volume.

4. The tubing hanger of claim 2, wherein the container contracts when there is a positive difference between the pressure in the inner cavity and the pressure in the external well volume.

5. The tubing hanger of claim 2, wherein the container comprises a bellows having an outer surface that is acted upon by pressure inside the inner cavity and an inner surface that is acted upon by pressure in the external well volume.

6. The tubing hanger of claim 5, wherein the bellows comprises metal.

7. The tubing hanger of claim 1, comprising a sealing device between the pressure compensator and the tubing hanger, the sealing device preventing fluid communication between the inner cavity and the external well volume.

8. The tubing hanger of claim 1, comprising a sealing device between the control line and the tubing hanger, the sealing device preventing fluid communication between the inner cavity and the external well volume.

9. The tubing hanger of claim 1, wherein the spacer block comprises polyetheretherketone (PEEK).

10. The tubing hanger of claim 1, wherein the inner cavity comprises dielectric fluid.

11. The tubing hanger of claim 1, wherein the control line comprises one of an electrical cable and a fiber optic cable.

12. A tubing hanger comprising:

a tubing hanger body having an inner cavity that is sealed with respect to an external well volume, the inner cavity comprising first and second passageways, wherein the first passageway extends through the tubing hanger body and the second passageway is defined within the first passageway and extends tangentially therefrom to be in fluid communication with the external well volume, wherein the second passageway is further defined by a tube, the tube having an outer circumference that is sealed to the tubing hanger body and having a port that communicates with the external well volume;

a plurality of spacer blocks disposed within the inner cavity, wherein the plurality of spacer blocks comprise first and second conduits at least partially disposed therein;

a control line extending through the first passageway and also through the first conduit to communicate with downhole equipment; and a bellows disposed in the second conduit and configured to adjust differential pressure between the inner cavity in the external well volume, wherein the differential pressure acts on the bellows and causes the bellows to change size, and wherein the bellows comprises an inner chamber in fluid communication with the second passageway.

13. The tubing hanger of claim 12, comprising an insulation element disposed in the first passageway and encompassing a connection point in the control line.

14. The tubing hanger of claim 13, wherein the connection point joins a first portion of the control line that extends axially through the tubing hanger body and a second portion of the control line that extends tangentially through the tubing hanger body relative to the first portion.

* * * * *